United States Patent [19]

Mamelson et al.

[11] Patent Number: 5,035,085

[45] Date of Patent: Jul. 30, 1991

[54] REFRIGERATOR DOOR ASSEMBLY WITH THERMAL INSULATED DOOR MOUNTING FRAME

[75] Inventors: Richard Mamelson, Crown Point, Ind.; Allen Watson, Hopkinsville, Ky.

[73] Assignee: Ardco, Inc., Chicago, Ill.

[21] Appl. No.: 303,445

[22] Filed: Jan. 27, 1989

[51] Int. Cl.[5] ..... E06B 1/04

[52] U.S. Cl. ..... 49/504; 49/478; 62/248

[58] Field of Search ..... 49/504, 478; 62/248

[56] References Cited

U.S. PATENT DOCUMENTS

| | | | |
|---|---|---|---|
| 4,004,370 | 1/1977 | Heaney | 49/504 |
| 4,034,513 | 7/1977 | Richardson | 49/504 |
| 4,741,127 | 5/1988 | Bockwinkel | 49/501 |
| 4,852,303 | 8/1989 | Rolek | 49/504 |

*Primary Examiner*—Kenneth J. Dorner
*Assistant Examiner*—Gerald A. Anderson
*Attorney, Agent, or Firm*—Leydig, Voit & Mayer

[57] ABSTRACT

A refrigerator door assembly having a door mounting cabinet frame which has a thermally efficient composite design comprising a non-metallic pultrusion-formed structural frame member and an outer metallic trim panel mountable on the structural frame member for providing the desired finished appearance, which may be made consistent with conventional commercial refrigerator and freezer door assemblies. The door mounting frame includes a mullion which also includes a pultrusion formed non-metallic structural element. A rigid plastic molding assembly encompasses the rear and sides of the structural frame members and define air insulating spaces about the frame members. The pultrusion formed frame members permit thermal insulated mounting of metallic accessories by ultransonic welding methods.

32 Claims, 2 Drawing Sheets

Fig. 4.

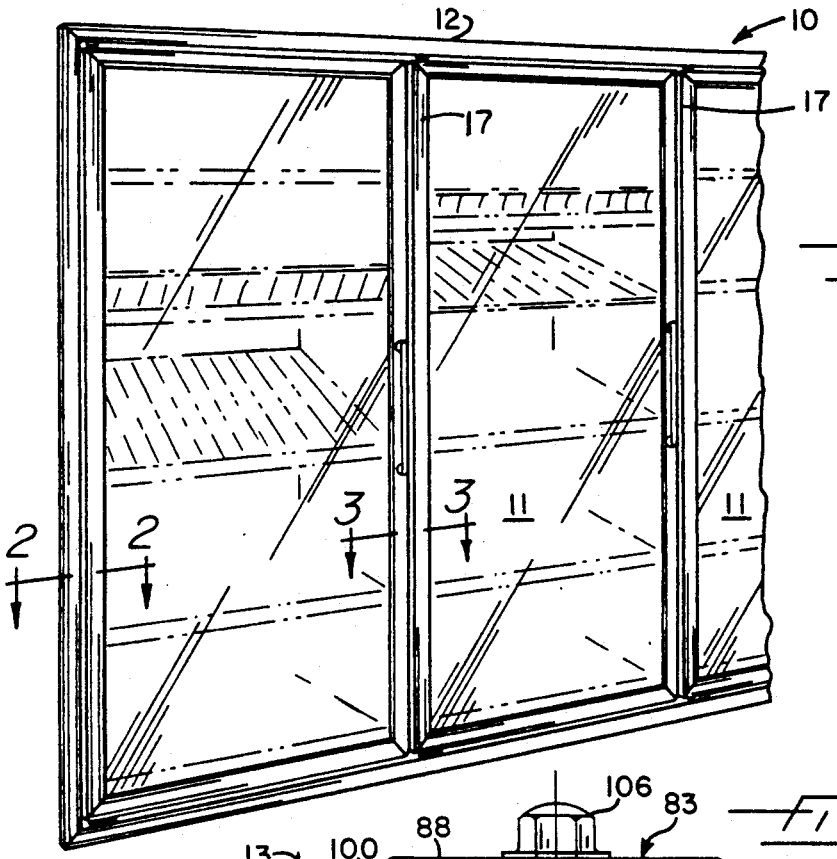
Fig. 1.
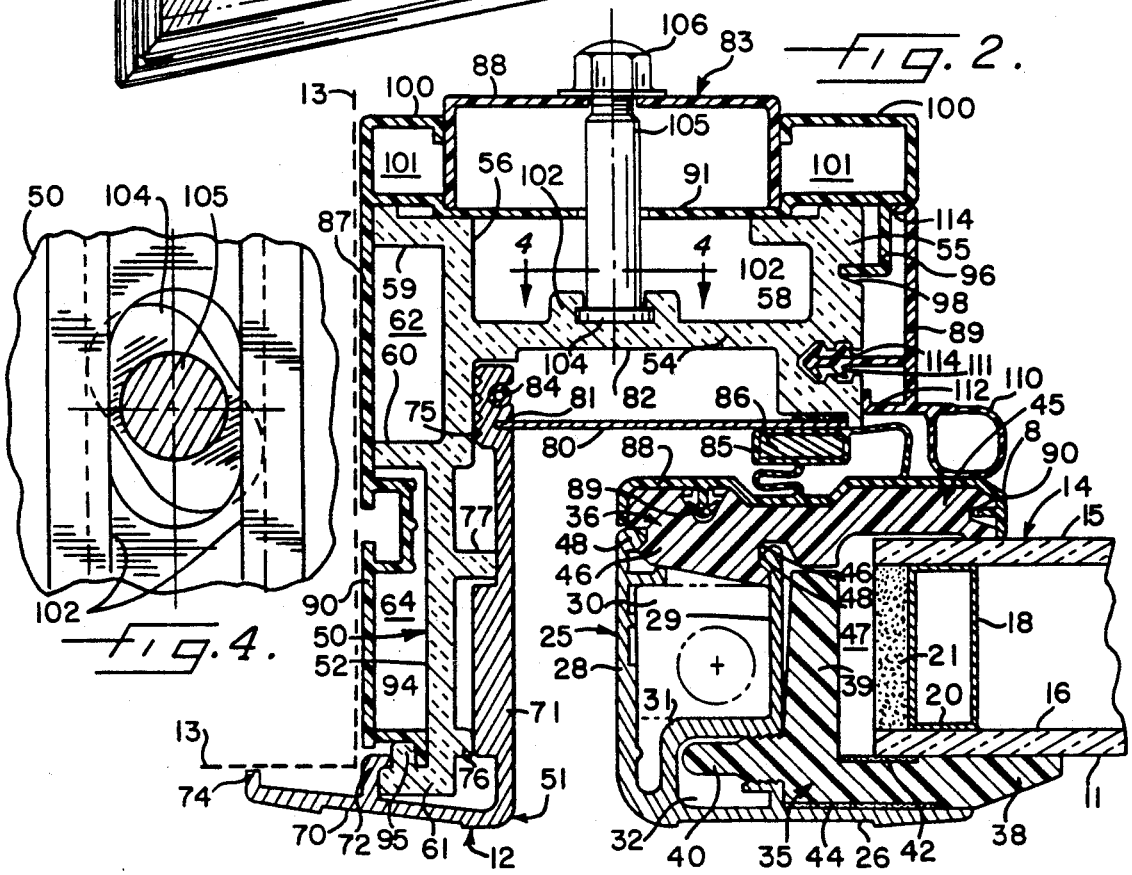
Fig. 2.
Fig. 4.

Fig. 3.
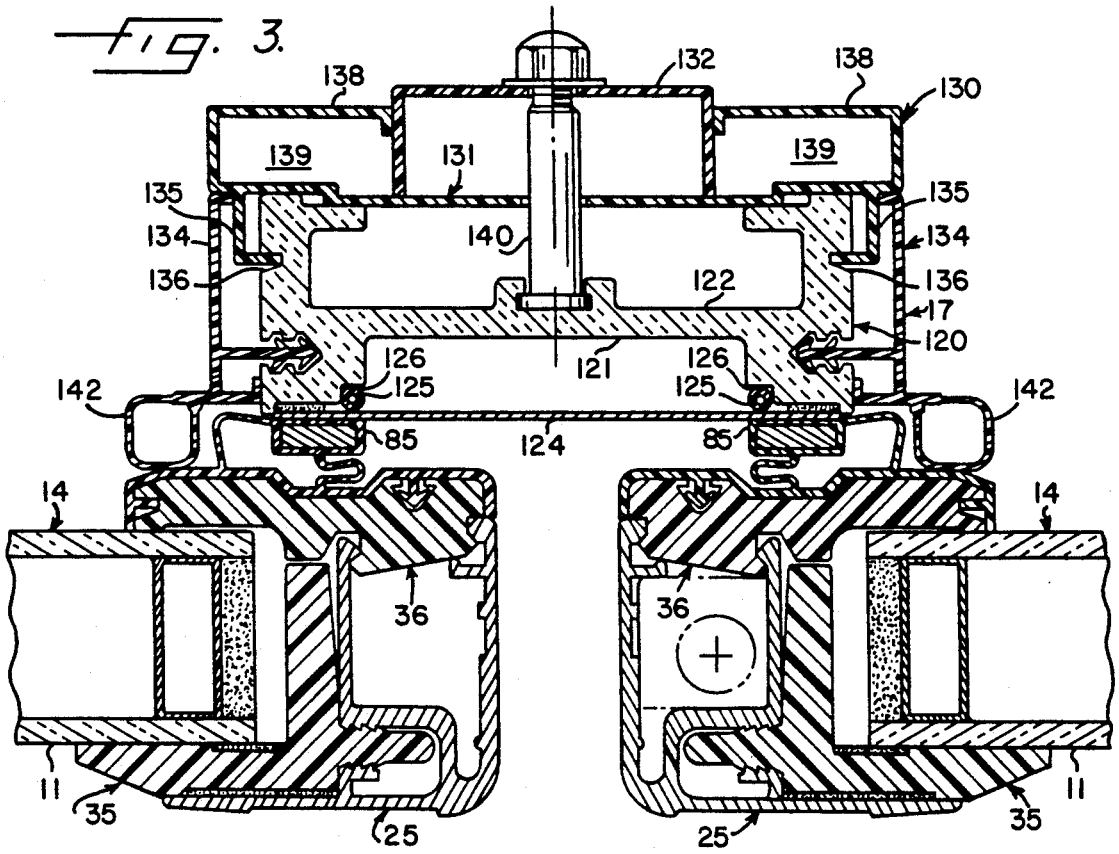
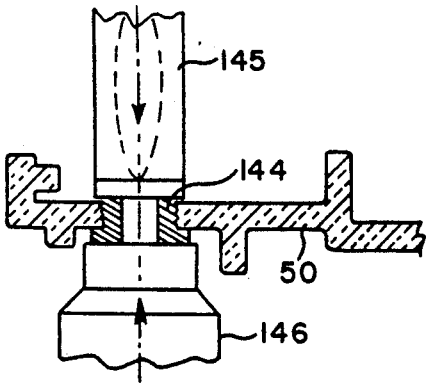
Fig. 5

REFRIGERATOR DOOR ASSEMBLY WITH THERMAL INSULATED DOOR MOUNTING FRAME

DESCRIPTION OF THE INVENTION

The present invention relates generally to door assemblies for commercial refrigerators and freezers, and more particularly, to an improved more thermally efficient door mounting frame.

Commercial refrigerators and freezers, such as employed in supermarkets, generally comprise a cabinet or room having a rectangular opening in one of the vertical walls. A door mounting frame is inserted within this opening, and a plurality of insulated glass doors are mounted within the frame. Because the insulated glass doors usually comprise a plurality of glass panes, they are relatively heavy and require a sturdy and rugged frame for supporting their weight and for withstanding abusive repeated opening and closing that occurs in commercial establishments. Since it is desirable for the door mounting frame to have a finished and decorative appearance and a specifically configured form, it typically is formed from aluminum extrusions.

Such aluminum extrusions also are highly heat conductive. The normal operating temperature for commercial refrigeration units is between about 34° F. and 36° F., while commercial freezer units may be operated as low as −30° F. If preventative measures are not taken, portions of the metal frame will cool to temperatures below the dew point temperature of the ambient air, resulting in the accumulation of condensation and/or frost on the surface of the frame. Such condensation build up in commercial refrigeration and freezer door assemblies is undesirable since it can create a puddle below the door which is a safety hazard. It further distracts from the appearance of the door and graphically shows the waste of energy.

To prevent condensation and frost formation on the metal door mounting frame, it has been the practice to include electrical resistance heating wires within the frame for maintaining the portions of the frame exposed to warmer ambient air at a temperature above the dew point of the ambient air. Such electrical heating, however, can significantly increase the operating cost of the refrigerator or freezer unit. While considerable efforts have been directed toward combating condensation build up and minimizing heating requirements, such as by insulating the frame or interrupting the heat conductive path through the frame by means of thermal barriers or breaks, these efforts have not been entirely successful and often complicate the manufacture of the frame.

It is an object of the present invention to provide a door mounting frame for commercial refrigerators and freezers that has improved thermal efficiency and which is relatively simple and economical in construction.

Another object it to provide a relatively high strength door mounting frame which utilizes non-metallic, less heat-conductive, members as structural components thereof.

A further object is to provide a refrigerator door mounting frame of the foregoing type which permits relatively easy thermal-insulated mounting of accessories thereon.

Yet another object is to provide a refrigerator door mounting frame of the above kind which has a finished metallic exterior frame portion that matches conventional refrigerator and freezer frames.

Still a further object is to provide an improved sealing arrangement between the refrigerator door and mounting frame.

Other objects and advantages of the invention will become apparent upon reading the following detailed description of a preferred embodiment of the invention and upon reference to the accompanying drawings, wherein:

FIG. 1 is a perspective of a refrigerator door assembly having a door mounting frame embodying the present invention;

FIGS. 2 and 3 are fragmentary sections taken in the planes of lines 2—2 and 3—3, respectively, in FIG. 1;

FIG. 4 is an enlarged fragmentary section taken in the plane of line 4—4 in FIG. 2; and FIG. 5 is an enlarged, partially diagrammatic depiction showing a sonic welding method of securing a hinge or accessory receiving bushing to the structural component of the illustrated door mounting frame.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIGS. 1-3 of the drawings, there is shown an illustrative refrigerator door assembly 10 comprising a plurality of insulated glass doors 11 mounted for swinging movement in a door mounting frame 12, which in turn is mounted within the opening of a front wall 13 (FIG. 2) of a refrigerator cabinet or the like. It will be understood that the door assembly 10 is particularly adapted for use in free standing refrigerator or freezer cases or built-in coolers or cabinets of the type used in supermarkets and other retail stores to display refrigerated or frozen merchandise. The door mounting frame 12 extends about the periphery of the opening in the wall 13 and includes a plurality of mullions 17 that extend vertically between the top and bottom perimeters of the frame to provide rigidity for the frame 12 and define sealing surfaces against which free swinging sides of the doors 11 engage when in a closed condition.

The insulated glass doors 11 may be of a type disclosed in U.S. Pat. No. 4,741,127, assigned to the same assignee as the present application. As best shown in 2 each door 11 includes insulated glass unit 14 comprising a pair of glass panes 15, 16, disposed in parallel side-by-side relation separated by a spacer 18. As is known in the art, the spacer 18 may comprise a plurality of elongated metal tubular members disposed in a rectangular arrangement between the panes 15, 16, in this case each being spaced inwardly a small distance from the peripheral edges of the glass panes. A sealant 20 is provided between the sides of the spacer 18 and the adjacent glass panes 15, 16 for establishing a primary vapor seal, and a layer 21 of a flexible sealant fills the area between the panes about the outer periphery of the spacer 18.

For supporting the glass unit 14 and providing a decorative finished trim about the outer perimeter thereof, each door 11 has a metal outer frame 25, preferably assembled from a plurality of extrusions made of aluminum or other suitable metal which are disposed along respective peripheral sides of the glass unit 14. The outer metal frame 25 has a front wall 26, an outer side wall 28, and an inner side wall 29. The outer and inner side walls 28, 29 define a rearwardly opening channel space 30. The inner wall 29 is formed with an outwardly directed corner portion 31 which together with the front wall 26 defines an inwardly opening channel space 32 closely adjacent the inside of the front wall 26.

In order to retain the glass unit 14 within the outer metal frame 25 and to form a thermal barrier between the outer metal frame 25 and the glass unit 14 and between the outer metal frame 25 and the door mounting frame 12 within which the door is mounted, a pair of rigid, non-metallic thermal insulating barrier members 35, 36 are provided in adjacent side-by-side relation. The thermal insulating barrier members 35, 36 preferably are molded, expanded, or extruded of a plastic foam material, such as commercially available structural foam that may be formed with a solid, non-porous skin and a low density closed cell core so as to combine high strength with light weight.

The barrier member 35 on the front side of the door includes a front leg 38 disposed in abutting relation against the outer face of the front glass pane 15 and a side leg 39 which extends rearwardly therefrom in spaced relation to the outer periphery of the insulated glass unit 14. The barrier member 35 further includes an outwardly extending leg 40 that is press fit into the channel space 32. For further securing the outer metal frame 25 to the thermal barrier member 35, an adhesive 42 is provided between the front pane 15 and the front leg 38 of the barrier member 35, and a strip 44 of similar tape or a suitable adhesive is provided between the front leg 38 of the barrier member 35 and the front wall 26 of the outer metal frame 25.

For captively retaining the glass unit 14 between the thermal barrier members 35, 36 without the necessity for auxiliary fastening members, the rearwardly located barrier member 36 is releasably engageable with the outer metal frame 25 and is formed with a depending leg 45 that engages the rear pane 16. To releasably connect the rear barrier member 36 to the outer metal frame 25, the forwardly facing side of the barrier member 36 is formed with notches 46 which cooperate with flanges 48 formed on the rearwardly extending ends of the side walls 28, 29. The side walls 28, 29 have sufficient resiliency to permit forceful snapping of the flanges 48 into mounted position in the notches 46. To enhance firm support of the glass unit 14 within the barrier members 35, 36, a hot melt adhesive (not shown) may be provided at selected locations in the space 47 between the barrier member 35, 36 and the outer periphery of the glass unit. Since the barrier members 35, 36 have relatively low heat conductivity, the barrier members thermally isolate the outer metal frame 25 from the insulated glass unit 14 and from the cabinet frame 12.

In accordance with the invention, the door mounting cabinet frame has a thermally efficient composite design comprising a non-metallic, pultrusion-formed structural frame member and an outer trim panel mountable on the structural frame member for providing a desired finished appearance, which may be made consistent with conventional commercial refrigerator and freezer door assemblies if desired. To this end, in the illustrated embodiment, the cabinet frame 12 includes a plurality of interconnected pultrusion-formed fiberglass reinforced structural members 50, each having a respective outer trim panel 51 mounted thereon in overlying relation to the otherwise forwardly exposed portions of the structural frame member 50. The structural frame members 50 in this instance each are generally L-shaped, having a side wall 52 disposed adjacent a peripheral side of the opening in the cabinet wall 13 and a transverse wall 54 extending inwardly into the opening from the rear of the side wall 52 for establishing a stop for the swinging doors 11. The transverse wall 54 is formed with a pair of rearwardly extending reinforcing flanges 55, 56 which define a rearwardly opening channel or recess 58, and the side wall 52 is formed with outwardly extending reinforcing flanges 59, 60, 61 at forward, intermediate, and rearward locations, respectively, for defining a pair of outwardly opening recesses 62, 64. It will be appreciated that the structural frame members 50 may be economically formed with the desired cross sectional configuration for optimum rigidity and thermal efficiency by known pultrusion techniques, preferably being made of fiberglass reinforced thermoplastic material. Such structural frame members have relatively high strength and rigidity, and by virtue of their non-metallic construction, minimize heat transfer between cold and warm sides of the door mounting frame 12, which heretofore has created condensation and frost problems in conventional refrigerator door assemblies formed of aluminum extrusions or other metallic structural frame elements.

The forward trim panels 51 of the composite door mounting frame 12, which may be extrusions of aluminum or other metallic material, are appropriately joined together in a rectangular arrangement. The illustrated trim panels 51 have a generally L-shaped configuration, with a front wall 70 extending outwardly in overlying relation to the forward end of the frame member wall 52 and a portion of the front face of the cabinet wall 13, and a jam portion 71 extending rearwardly of the front wall 70 in adjacent relation an inner side of the frame member side wall 52. The front wall 70 of the trim panel 51 has a rearwardly extending mounting flange 72 at an intermediate location for locking engagement with the outwardly extending flange 61 of the frame member 50. A rearwardly turned outer end 74 of the front wall 70 abutts the cabinet wall 13 for maintaining the desired spacial relation to the cabinet wall 13 and the trim panel front wall 70. The jam portion 71 has an outwardly extending mounting end 75 engaging the side wall 52 of the frame member 50, and the latter is formed with a pair of inwardly extending reinforcing and mounting flanges 76, 77 for defining dead air spaces between the jam portion 71 and the side wall 52. For minimizing direct material contact between the jam portion 71 and frame member 50, the mounting end 75 of the jam portion 71 has a serrated face. Since the trim panel 51 completely encompasses the otherwise exposed portions of the forwardly extending side wall 52 of the frame member 50 and can be formed of aluminum or other desired material, it will be seen that the trim panel 51 can be custom designed for achieving the desired finished appearance for the door mounting frame 12.

To cover the front of the transverse wall 54 of the frame member 50 and to define a sealing surface against which the doors 11 close, a sealing plate 80 is provided, which preferably is made of metallic or vinyl clad material. The sealing plate 80 has an outer end retained in an inwardly directed recess 81 formed in the jam portion 71 of the trim panel 51 and an inner end adhesively secured to the frame member 50. The transverse wall 54 of the structural frame member 50 is formed with a forwardly opening recess 82 for defining a dead air space between the sealing plate 80 and the structural frame member 50. As viewed in FIG. 2, it can be seen that the forwardly and rearwardly opening recesses 82, 58 on respective forward and rearward sides of the transverse wall 54 provide the transverse walls with a generally H-shape configuration for enhanced strength and rigidity. In the illustrated embodiment, an electrical heating wire 84 is positioned in a groove in the jam portion 71 of the trim panel 51 immediately behind the sealing plate 80 for enabling heating, if necessary, of the adjacent portion of the sealing plate, exposed to ambient air in order to maintain its temperature above the dew point of the ambient air.

For providing a seal between the door 11 and sealing plate 80 when the door is in a closed position, a gasket 85 is secured to the rear side of each door 11. The gasket 85 contains magnets 86 for creating a magnetic attraction with the sealing plate 80. The gasket 85 in this case is affixed to a carrying plate 88 having an anchor 89 and retaining flange 90 adapted for snap action engagement with the barrier member 36.

For enclosing the rear and opposed sides of the structural frame member 12 from the cold side of the refrigerator cabinet and for creating air insulating zones about the frame member, a molding assembly 83 is releasably mountable on the structural frame member 12, in this case comprising a PVC plastic L-shaped molding 87, a wireway molding 88, and a side molding 89. The L-shaped molding 87 has a first leg 90 overlying the outside of the frame member side wall 52 for enclosing the channels 62, 64 and defining dead air spaces between the molding 87 and frame member 50, and a second leg 91 coextensive with and encompassing the rear side of the frame member 50 and enclosing the channel recess 58 to define a further air insulating spaces. The L-shaped molding 86 is adapted for snap action engagement about the frame member 50, being formed with an inwardly directed flange 94 at one end for locking engagement under a retaining flange 95 extending rearwardly of the frame member flange 61. The second leg 91 of the L-shaped molding is formed with a forwardly directing retaining L-shaped flange 96 for engaging a notch 98 formed in the side of the frame member 50.

For defining a wireway for electrical wires, as well as a further air insulating space rearwardly of the structural frame member, the wireway molding 88 is channel-shaped and is mounted rearwardly of the L-shaped molding 87 with forwardly directed legs thereof abutting the rear side of the L-shaped molding 87. For properly locating the wireway molding 88 on the L-shaped molding 87, the L-shaped molding leg 91 is formed with a pair of L-shaped flanges 100 extending rearwardly from opposite ends thereof for engaging opposed sides of the wireway channel molding 8 and for defining still further dead air spaces 101 on opposed sides thereof. The wireway molding 88 in this case extends rearwardly a slight distance beyond the L-shaped flanges 100. For securing the wireway molding 88, the rear side of the frame member 50 is formed with a pair of longitudinally extending L-shaped flanges 102 which define a retaining channel along the length of the frame member 50. Elongated heads 104 of mounting studs 105 are positionable into the channel between the flanges 104 and then twisted into locking position, as shown in FIG. 4. The mounting studs 104 each have a threaded end extending rearwardly of the frame member 50 through apertures in the moldings 87, 88 which is engaged by a suitable nut 106.

In accordance with a further aspect of the invention, the side molding 89 encompasses an inner side of the transverse wall 12 of the frame member 50 and is formed with a resilient gasket 110 for engagement with the door 11 on the cold air side of the sealing gasket 85 for creating a double seal between the door and mounting frame and for preventing communication of cold air to the sealing gasket 85 when the door is in a closed condition. The side molding 89 has an outwardly directed resilient anchor 111 positively retained within the side of the frame member 50 and relatively rigid outwardly extending mounting flanges 112, 114 at opposed ends for abutting engagement with the frame member 50 and L-shaped molding 87, respectively, for defining dead air spaces between the side of frame member 50 and side molding 89. The resilient gasket 110 is annular in cross section and extends forwardly of the side molding beyond the plane of the sealing plate 80. It will be seen that when a door 11 is closed the annular sealing gasket 110 contacts the doors as the magnetic sealing gasket 85 is brought into engagement with the sealing plate 80, resulting in the double seal.

In keeping with the invention, the mullions 17 of the door mounting frame 12 similarly each have a fiberglass reinforced thermoplastic structural member 120. The structural member 120 for the mullion 17 in this case is H-shaped, defining channel recesses 121, 122 on the forward end rear sides thereof, respectively. A sealing plate 124 is adhesively secured to the front of the frame member 120 to enclosed the channel recess 121 and form a dead air insulating space immediately adjacent the rear of the sealing plate 124. The sealing plate 124 serves as the sealing and stop surface for the free swinging sides of a pair of doors 11, as shown in FIG. 3, with the magnetic sealing gaskets 85 of the doors 11 engaging opposite sides of the sealing plate 124. For maintaining the portions of the sealing plate 124 exposed to ambient air above the dew point temperature of the ambient air, electrical heating elements 125 are mounted immediately adjacent the inside face of the sealing plate 124 in grooves 126 formed on opposed sides of the recess 121 of the frame member 120.

For enclosing the rear and opposite sides of the frame member 120 and for defining dead air insulating spaces about the frame member, a molding assembly 130 comprising a rear molding 131, a wireway molding 132, and a pair of side moldings 134, is mounted on the frame member 120. The rear molding 131, which encompasses the rear of the frame member 120 and encloses the channel recess 122, has a pair of forwardly extending retaining flanges 135 at opposite sides that are releasably engageable in notches 136 in the sides of the frame member 120. The rear molding 131 further has rearwardly extending L-shaped flanges 138 for centering the wireway molding 132 and for defining further dead air spaces 139 in a manner similar to that previously described, with the wireway molding 132 similarly being retained by studs 140 mounted in rearwardly extending fashion from the frame member 120. The side moldings 134, which are similar to the side moldings 89 previously described, each have a resilient forwardly extending annular gasket 142 for engaging a respective door 11 closed against the mullion 17 for preventing communication of cold air to the adjacent magnetic sealing gasket 85 of the door.

It will be appreciated that by virtue of the non-metallic construction of the frame members 50, 120 and the vinyl mold assemblies 85, 130 which encompass the rear and opposite sides of the frame members, the door mounting frame 12 has improved thermal efficiency over conventional commercial refrigerator and freezer frames which utilize aluminum or other metal extrusions as the primary structural element. Moreover, the non-metallic structural frame members 50, 120 lend themselves to easy insulated mounting of accessories. For example, light fixtures may be secured rearwardly of the mullion by studs similar to the wireway molding retaining studs 105, 140. Moreover, when metal studs, bushings, or the like are required for mounting of accessories, they may be readily installed in the frame members in thermally isolated relation t the doors by ultrasonic welding techniques. As shown in FIG. 5, a bushing 144, such as might be used for receiving a bolt or door accessory, is positioned within an aperture formed in the frame member 50. An ultrasonic welding device comprising a oscillating head 145 and a sound reflector 146 can be employed to create high energy concentrations at the junction between the frame member 50 and bushing 144 through ultrasonic vibrations to effect secure bonding therebetween.

From the foregoing, it can be seen that a door mounting frame for commercial refrigerator and freezers is provided which has improved thermal efficiency and which is relative simple and economical in construction. While the frame utilizes high strength non-metallic structural frame members, the door mounting frame may have a finished metallic exterior appearance consistent with conventional refrigerator and freezer frames that might exist in commercial establishments.

We claim as our invention:

1. In a refrigerator cabinet having a wall formed with an opening, a refrigerator door assembly mountable in said wall opening, said refrigerator door assembly comprising a door mounting frame, at least one insulated door comprising a plurality of glass panels mounted on said frame, said door mounting frame including an L-shaped structural frame member having a side wall positionable adjacent the periphery of said wall opening and a transverse wall extending from said frame member side wall into said opening for defining a stop for said door, said transverse wall including a central portion in a plane parallel to said wall opening and said portions extending forwardly and rearwardly of said central portion in an H-shape cross-sectional configuration for defining a forwardly opening recess on a forward side of said central portion and a rearwardly opening recess on a rear side of said central portion, rigid plastic molding means surrounding rear and opposite sides of said frame member and enclosing said rearwardly opening recess for defining an air insulating space on the rearward side of said frame member central portion, and a sealing plate mounted on a forward side of said transverse wall for defining a sealing surface against which said door closes and for enclosing said forwardly opening recess to define an air insulating space immediately adjacent a rear side of said sealing plate.

2. In the refrigerator cabinet of claim 1 in which said door is pivotally mounted on said frame.

3. In the refrigerator cabinet of claim 2 in which said molding means includes an L-shaped molding that encompasses an outer side of said frame member side wall and a rear side of said frame member transverse wall.

4. In the refrigerator cabinet of claim 3 in which said L-shaped molding is releasably engageable with said frame member.

5. In the refrigerator cabinet of claim 3 in which said frame member side wall is formed with outwardly opening recesses which are enclosed by said L-shaped molding to define dead air insulating spaces.

6. In the refrigerator cabinet of claim 3 in which said molding means includes a wireway molding mounted on the rear side of said L-shaped molding for defining a wireway for electrical wires and a further insulating space rearwardly of said structural frame member, and means for securing said wireway molding in mounted position.

7. In the refrigerator cabinet of claim 6 in which said wireway molding is channel shaped with forwardly directed legs in abutting relation to the rear side of said L-shaped molding.

8. In the refrigerator cabinet of claim 7 in which said frame member transverse wall is formed with a rearwardly opening longitudinally extending channel, and said means for securing said wireway molding in mounted position on said L-shaped molding includes studs having heads retained in said frame member channel and extending rearwardly through said L-shaped molding and wireway molding.

9. In the refrigerator cabinet of claim 8 in which said studs have elongated heads which are positionable into said frame member channel and twisted into locking positions.

10. In the refrigerator cabinet of claim 1 including a trim panel having a side wall overlying an inner side of said frame member side wall and a front wall overlying a front end of said frame member side wall and a portion of said cabinet wall immediately adjacent said opening for providing the desired finished appearance for said door mounting frame.

11. In the refrigerator cabinet of claim 10 in which said trim panel front wall has a rearwardly extending mounting flange in locking engagement with said frame member.

12. In the refrigerator cabinet of claim 11 in which said frame member side wall has a locking flange adapted for interlocking engagement with said trim panel locking flange.

13. In the refrigerator cabinet of claim 11 in which said frame member and trim panel side walls define an air insulating space therebetween.

14. In the refrigerator cabinet of claim 13 in which the inner side of said frame member side wall is formed with inwardly directed mounting flanges for maintaining said trim panel side wall in predetermined spaced relation to said frame member.

15. In the refrigerator cabinet of claim 1 including a plurality of doors mounted on said door mounting frame, and said door mounting frame including at least one mullion extending between top and bottom sides of said frame and against which said doors close.

16. In the refrigerator cabinet of claim 15 in which said mullion frame member is formed with a forwardly directed recess, and a sealing plate enclosing said mullion frame member forwardly opening recess for defining an air insulating space immediately adjacent a rear side of said sealing plate.

17. In the refrigerator cabinet of claim 15 in which said mullion frame member is H-shaped so as to define recesses on forward and rear sides thereof, said sealing plate enclosing said front recess for defining an air insulating space immediately adjacent the rear side of said sealing plate, and molding means encompassing the rear side of said mullion frame member and enclosing said recess on the rear side thereof for defining a further air insulating space.

18. In the refrigerator cabinet of claim 15 in which said mullion frame member is made of a pultrusion formed fiberglass reinforced material.

19. In the refrigerator cabinet of claim 15 in which said mullion includes rigid plastic molding means surrounding rear and opposite sides of said mullion frame member.

20. In the refrigerator cabinet of claim 19 in which said mullion molding means and mullion frame member define air insulating spaces adjacent rear and opposed sides of said mullion frame member.

21. In the refrigerator cabinet of claim 19 in which said mullion molding means includes a rear molding encompassing the rear side of said mullion frame member and side moldings encompassing respective sides of said mullion frame member.

22. In the refrigerator cabinet of claim 21 in which said mullion molding means and mullion frame member define air insulating spaces adjacent rear and opposed sides of said mullion frame member.

23. In the refrigerator cabinet of claim 1 in which said molding means and frame member define air insulating spaces adjacent opposed sides of said frame member.

24. In the refrigerator cabinet of claim 1 in which said structural frame member is made of pultrusion formed fiberglass reinforced thermoplastic material and said trim panel is made of metal.

25. A refrigerator door assembly mountable in an opening in the wall of a refrigerator cabinet comprising a door mounting frame, at least one insulated door mounted on said frame, said door mounting frame including a non-metallic structural frame member having a side wall positionable adjacent the periphery of said wall opening, a trim panel having a side wall overlying an inner side of said frame member side wall and a front wall overlying a front end of said frame member side wall and a portion of said cabinet wall immediately adjacent said opening for providing the desired finished appearance for said door mounting frame, said frame member having a transverse wall defining a stop for said door, a sealing plate mounted on a front side of said transverse wall, said door having a sealing gasket mounted on an outer periphery thereof for engaging said sealing plate when the door is in a closed position, rigid plastic molding means surrounding rear and opposite sides of said frame member including a side molding encompassing a side of said frame member transverse wall and forming an air insulating space therebetween, and said side molding including a forwardly extending resilient gasket for creating a further seal between said door and door mounting frame when said door is in a closed position.

26. The refrigerator door assembly of claim 25 in which said resilient gasket of said side molding has an annular cross sectional configuration and extends forwardly beyond the plane of said ceiling plate.

27. The refrigerator door assembly of claim 26 in which said side molding resilient gasket engages at said door on a cold side of said door mounted sealing gasket when the door is in a closed position for preventing communication of cold air to said door mounted sealing gasket.

28. A refrigerator door assembly mountable within the opening in the wall of a refrigerator cabinet comprising a door mounting frame having an outer peripheral portion mountable within said cabinet opening, a plurality of insulated doors mounted for pivotal movement on said frame, said frame including at least one mullion extending between top and bottom sides thereof and against which said door close, said mullion including a structural frame member having a generally H-shaped cross section which includes a central wall parallel to said wall opening and side walls extending forwardly and rearwardly of said central wall for defining forwardly and rearwardly opening recesses extending substantially across the entire forward and rear sides thereof respectively, a sealing plate mounted on a forward side of said mullion structural frame member for defining a sealing and stop surface against which said doors close and for enclosing said forwardly opening recess for defining an air insulating space immediately adjacent the rear side of said sealing plate, and rigid plastic molding means surrounding rear and opposite sides of said frame member and for enclosing said rearwardly opening recess for defining an air insulating space immediately adjacent a rear side of said central wall.

29. The refrigerator door assembly of claim 28 in which said mullion frame member is made of a pultrusion formed fiberglass reinforced thermoplastic material.

30. The refrigerator door assembly of claim 28 in which said molding defines insulating air spaces adjacent opposite sides of said mullion frame member.

31. The refrigerator door assembly of claim 28 in which said structural frame member is non-metallic.

32. A refrigerator door assembly mountable in an opening in the wall of a refrigerator cabinet comprising a door mounting frame, at least one insulated door mounted on said frame, said door mounting frame including an L-shaped structural frame member having a side wall positionable adjacent the periphery of said wall opening and a transverse wall extending from said frame member side wall into said opening for defining a stop for said door, rigid plastic molding means surrounding rear and opposite sides of said frame member, said molding means including an L-shaped molding having a first portion interposed between said wall an outer side of said frame member side wall and a second portion encompassing a rear side of said frame member transverse wall, said frame member side and transverse walls being formed with an outwardly and rearwardly opening recesses extending into said side and transverse walls respectively at least one-half the thickness of said frame member side and transverse walls, said L-shaped molding covering said outwardly and rearwardly opening recesses to define dead air insulating spaces therebetween, a trim panel having a side wall overlying an inner side of said frame member side wall and a front wall overlying a front end of said frame member side wall and a portion of said cabinet wall immediately adjacent said opening for providing the desired finished appearance for said door mounting frame, said frame member transverse wall further being formed with a forwardly opening recess, and a sealing plate enclosing said forward opening recess to define an air insulating space adjacent the rear side of said sealing plates.

* * * * *